United States Patent [19]

Felthuis et al.

[11] Patent Number: 4,576,081

[45] Date of Patent: Mar. 18, 1986

[54] CERAMIC SEALING ROPE

[75] Inventors: Jacob Felthuis, Oudorp; Joseph H. Tournier, Rotterdam, both of Netherlands

[73] Assignees: Hoogovens Groep B.V., Ijmuiden; Keralox B.V., Rotterdam, both of Netherlands

[21] Appl. No.: 627,670

[22] Filed: Jul. 3, 1984

[30] Foreign Application Priority Data

Jul. 4, 1983 [NL] Netherlands ..... 8302366

[51] Int. Cl.[4] ..... D04C 1/02; D04C 1/12

[52] U.S. Cl. ..... 87/6; 57/210; 57/904; 87/8

[58] Field of Search ..... 87/1, 5–8, 87/11, 13; 57/210, 229, 255, 904

[56] References Cited

U.S. PATENT DOCUMENTS

| | | | |
|---|---|---|---|
| 1,331,679 | 2/1920 | Sherwood | 57/212 X |
| 2,667,804 | 2/1954 | Boyer et al. | 87/1 |

FOREIGN PATENT DOCUMENTS

| | | |
|---|---|---|
| 827382 | 7/1975 | Belgium . |
| 2389811 | 12/1978 | France . |
| 2410224 | 6/1979 | France . |
| 2473501 | 7/1981 | France . |
| 8102279 | 12/1981 | Netherlands . |
| 2021660 | 12/1979 | United Kingdom . |

*Primary Examiner*—John Petrakes

*Attorney, Agent, or Firm*—Stevens, Davis, Miller & Mosher

[57] ABSTRACT

Ceramic sealing rope, with a core of a strand (1) of yarns (2), each yarn (2) around a solid metal wire (3) and around the core one or more sleeves (4, 5, 7), each sleeve woven crosswire of multiple yarns, each yarn around a solid metal wire.

7 Claims, 2 Drawing Figures

CERAMIC SEALING ROPE

The invention relates to a ceramic sealing rope.

Ceramic sealing rope is applied at different places in the industry, such as for sealing of steel door windows against the refractory wall of coke ovens, cooling water pipes of reheating furnaces and between cathode blocks of electrolytic furnaces for the preparation of aluminium.

The invention intends to provide a ceramic sealing rope consisting of suitable materials put together to a suitable composition.

The invention proposes a ceramic sealing rope, with a core of a strand of yarns, each yarn around a solid metal wire, and around the core one or more sleeves each sleeve woven crosswise of multiple yarns, each yarn around a solid metal wire.

Naturally, the yarn consists of a refractory fibre of the usual ceramic wool, which, in order to keep these refractory fibres together during manufacture, is enriched with 12–20% viscose fibre.

The metal wire preferably has a thickness of approx. 0.1 mm and preferably consists of a heat-resistant stainless nickel alloy.

In a certain embodiment, the strand comprises approximately forty yarns.

For the sake of convenience, the thickness of the yarn in the sleeve is in itself the same as the thickness of the yarn in the strand but, if the number of yarns in the multiple crosswise weave of the sleeve amounts to one pair of two intertwined yarns, the apparent thickness of the yarn in the sleeve is more than that of the yarn in the core.

A ceramic sealing rope thus composed has a large number of advantages in use. In the first place, it has a high fire-resistance to approximately 1200° C. It has high stability, which means that it does not come apart under pressure load and retains a permanent mechanical strength at high temperatures. Further, it has good transformability to fit into different joints. It is flexible and can be securely pressed down into the joint. It is resilient to the original size. By the presence of the metal wire in each yarn, the fire-resistance as well as the mechanical strength are guaranteed. Further, the ceramic rope is so sturdy that several layers can be placed on top of each other should this be necessary. The rope has appeared to be reasonably gas-tight up to a pressure difference of 40 mm WG. It is free of asbestos.

The attached drawing provides a further impression of the ceramic rope according to the invention.

In the drawing,

FIG. 1 is a picture of a ceramic sealing rope with one single sleeve, while

Figure 1:
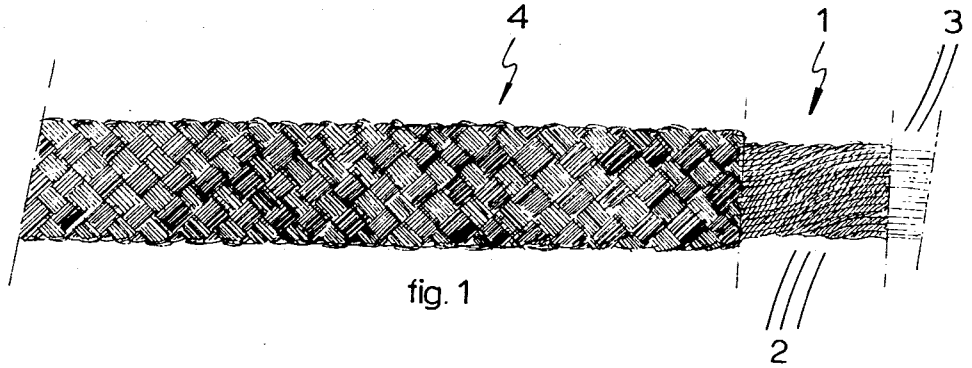

In both figures, a strand of yarns 2 is indicated with reference number 1, which strand in practice comprises approximately forty yarns of refractory fibre of ceramic wool , enriched with 12 to 20% viscose fibre. For refractory material can be used Kaoline, a synthetic fibre of 50% $Al_2O_3$ and 50% $SiO_2$, or a synthetic fibre of 60% $Al_2O_3$ and 40% $SiO_2$ or a fibre of 96% $Al_2O_3$. By increasing the percentage of $Al_2O_3$, the refractory quality is increased. As such a fibre itself does not have contexture, the fibre of the ceramic rope according to the invention in question is enriched with a percentage of 12 to 20% of viscose fibre, which serves to keep the refractory fibre together during manufacture. At an operating temperature of more than 300° C., the viscose does disappear but this hardly influences the stability of the ceramic sealing rope. The percentages as mentioned have been determined experimentally; with less than 12% viscose, no effect is noticeable, while above 20% the burnout appeared to be too high.

Each yarn is wrapped around a solid metal wire of heat-resistant stainless nickel alloy, such as INCONEL 600. In both figures, these wires are indicated by reference number 3. The thickness of these wires amounts to approximately 0.1 mm.

In FIG. 1, a sleeve 4 is fitted around the strand, which is composed of a crosswise weave of one pair of two intertwined yarns. These yarns also consist of refractory fibre of ceramic wool, again with 12 to 20% viscose fibre and are fitted around a solid metal wire (not drawn) also of heat-resistant stainless nickel alloy as mentioned.

Figure 2:
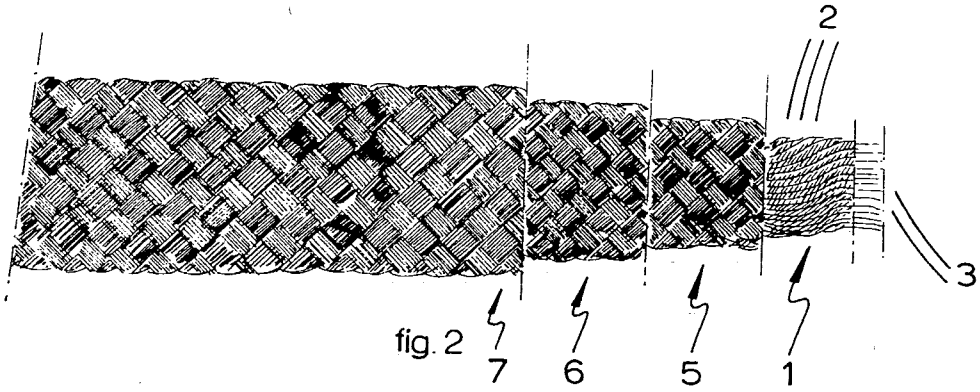
FIG. 2 shows a ceramic sealing rope according to the invention with three sleeves.

In case one wants to increase the sturdiness of the ceramic rope and also its diameter, it is possible to change to an embodiment of the rope as shown in FIG. 2, in which the core 1 is surrounded from the inside outward by a sleeve 5, a sleeve 6 and a sleeve 7. Each sleeve 5, 6 and 7 is again woven crosswise of multiple yarns and these yarns consist of refractory fibres of ceramic wool plus 12% to 20% viscose fibre, wrapped around a solid metal wire.

We claim:

1. Ceramic sealing rope comprising a core and at least one sleeve surrounding said core, said core comprising a plurality of solid metal wires and ceramic yarn wrapped around each of said solid metal wires, said sleeve comprising a plurality of ceramic yarns cross-woven about said core, each of said ceramic yarns cross-woven about said core being wrapped about a solid metal wire.

2. The rope according to claim 1, wherein each of the yarns consists of a refractory fiber of ceramic wool plus 12 to 20% viscose fiber.

3. The rope according to claim 2, wherein said metal wire has a thickness of approximately 0.1 mm and consists of a heat-resistant stainless nickel alloy.

4. The rope according to claim 1, wherein the metal wire has a thickness of approximately 0.1 mm and consists of a heat-resistant stainless nickel alloy.

5. The rope according to claim 1, wherein the core comprises approximately forty metal wires wrapped with ceramic yarns.

6. The rope according to claim 1, wherein the number of cross-woven yarns of the sleeve amounts to one pair of two intertwined yarns.

7. Ceramic sealing rope comprising a core of forty yarns of a refractory fiber of ceramic wool plus 12 to 20% viscose fiber and forty solid metal wires of a heat-resistant stainless alloy, a yarn being wrapped around each solid metal wire of a heat-resistant stainless alloy and at least one sleeve woven around said core, said sleeve being comprised of 2×2 intertwined yarns, woven crosswise and consisting of refractory fiber of ceramic wool plus 12 to 20% viscose fiber and solid metal wires of heat-resistant stainless steel alloy, each yarn being wrapped around a solid metal wire of a heat-resistant stainless alloy.

* * * * *